US006227376B1

(12) United States Patent
Handel et al.

(10) Patent No.: US 6,227,376 B1
(45) Date of Patent: May 8, 2001

(54) TWO-DIRECTIONAL REJECT AND MAKE-UP CONVEYOR SYSTEM

(75) Inventors: Gary A. Handel; Jeffrey J. Morrison, both of Austin, MN (US)

(73) Assignee: Hormel Foods, LLC, Austin, MN (US)

( * ) Notice: Subject to any disclaimer, the term of this patent is extended or adjusted under 35 U.S.C. 154(b) by 0 days.

(21) Appl. No.: 09/307,405

(22) Filed: May 7, 1999

(51) Int. Cl.[7] ..... B07C 5/36

(52) U.S. Cl. ..... 209/606; 209/914; 209/933; 198/369.2; 198/371.2

(58) Field of Search ..... 209/552, 695, 209/914, 922, 606, 933; 198/369.2, 371.1, 371.2

(56) References Cited

U.S. PATENT DOCUMENTS 4,541,824 * 9/1985 Muller ..... 198/371.2 X
4,765,488 * 8/1988 Moriarity ..... 209/551
5,429,223 * 7/1995 Moeller ..... 198/371.2 X
5,810,149 * 9/1998 Sandberg et al. ..... 198/369.2

FOREIGN PATENT DOCUMENTS

2225666 * 12/1973 (DE) ..... 198/371.2

* cited by examiner

*Primary Examiner*—Tuan N. Nguyen
(74) *Attorney, Agent, or Firm*—Mau & Krull, P.A.

(57) ABSTRACT

A two-direction reject and make-up conveyor system includes a supply conveyor system (30) and a first inspection conveyor (40) and a second inspection conveyor (41). The conveyors (40 and 41) are moveable in both a forward and reverse direction allowing items to be inspected to be rejected in both directions. The supply conveyor system (30) allows for the make-up of any rejected items onto the inspection conveyors (40 and 41).

17 Claims, 7 Drawing Sheets

TWO-DIRECTIONAL REJECT AND MAKE-UP CONVEYOR SYSTEM

BACKGROUND OF THE INVENTION

1. Field of the Invention

This invention relates generally to a system for inspecting a plurality of items and more particularly to a system for providing a plurality of inspected items, wherein the inspected items may be rejected in either of two directions and the inspected items are replaced from a supply conveyor.

2. Description of the Prior Art

In the past, bacon has normally been packaged in packages which include a plurality of individual bacon slices. These bacon slices are stacked together and form a single unit. Over the past several years, consumers have desired more convenient packaging. Preparing bacon has always been a relatively messy task and microwaveable bacon packages have been developed to make cooking bacon less messy. The microwave bacon packages include a plurality of bacon strips. Packing machines which are utilized to pack the bacon strips normally package four packages simultaneously. Therefore, in order to have an efficient packaging line, four sets of bacon slices which are of acceptable quality need to be indexed into the packaging machine at once.

The inspecting of the bacon as it approaches the machine has been a problem. It has been difficult to reject one set of bacon slices and provide for a make-up set of bacon slices to replace the rejected slices. Since the bacon slices are conveyed to the packaging machine side by side and also front and back, any one of the four sets could be rejected for quality reasons. The ability to efficiently and quickly reject a bad set of bacon slices and replace it with a new set of bacon slices has been problematical in that any one of four sets of bacon slices could be rejected at one of the four locations.

The present invention addresses the problems associated with the prior art devices and provides for a two-directional reject and make-up conveyor system to provide for inspected bacon sets to a packaging machine. It is also appreciated that the inspection system could also be utilized for items other than bacon.

SUMMARY OF THE INVENTION

The present invention is a two-directional reject and make-up conveyor system for inspecting items. The system has a first inspection conveyor having a forward section and a rear section. Each section is sized to accommodate an item to be inspected. A first drive mechanism indexes the first conveyor both forward and backward. A second inspection conveyor has a forward section and a rear section. Each section is sized to accommodate an item to be inspected. A second drive mechanism indexes the second conveyor both forward and backward. A first supply conveyor supplies the item to be inspected to the first inspection conveyor and a second supply conveyor supplies the item to be inspected to the second inspection conveyor. A receiving conveyor is positioned to receive two inspected items from the first inspection conveyor and two inspected items from the second inspection conveyor. The forward section of the first inspection conveyor, in cooperation with the receiving conveyor, has a transfer position and a reject position. The forward section of the second inspection conveyor, in cooperation with the receiving conveyor, has a transfer position and a reject position. The rear section of the first inspection conveyor, in cooperation with the first supply conveyor, has a transfer position and a reject position. The rear section of the second inspection conveyor, in cooperation with the second supply conveyor, has a transfer position and a reject position, wherein when two items are on the first and second inspection conveyors, each inspection conveyor is movable to either its transfer or reject position and each is indexable in either a forward or a rearward direction to selectively reject or accept each item.

In another embodiment, the invention is a method of inspecting items. The method includes sequentially placing a first forward item and a second rear item on a first inspection conveyor. The two items are then inspected. Any item that is not acceptable is then selectively rejected by indexing the inspection conveyor either forward or backward depending on whether the item occupies a forward or rear position. A make-up item for a rejected item is supplied from a first supply conveyor to the first inspection conveyor.

In another embodiment, the invention is a method of inspecting bacon drafts. The method includes sequentially placing a first forward bacon draft and a second rear bacon draft on a first inspection conveyor and sequentially placing a third forward bacon draft and a fourth rear bacon draft on a second inspection conveyor. The four bacon drafts are then inspected. Any bacon draft that is not acceptable is then selectively rejected by indexing the inspection conveyors either forward or backward depending on whether the bacon draft occupies a forward or rear position. A make-up bacon draft for a rejected bacon draft is supplied from a first supply conveyor to the first inspection conveyor and from a second supply conveyor to the second inspection conveyor.

In another embodiment, the invention is a two-directional reject and make-up conveyor system for inspecting items. The system includes a first inspection conveyor having a forward section and a rear section. Each section is sized to accommodate an item to be inspected. A first drive mechanism is provided for indexing the first conveyor both forward and backward. A first supply conveyor supplies the item to be inspected to the first inspection conveyor. A receiving conveyor receives two inspected items from the first inspection conveyor. The forward section of the first inspection conveyor, in cooperation with the receiving conveyor, has a transfer position and a reject position. The rear section of the first inspection conveyor, in cooperation with the first supply conveyor, has a transfer position and a reject position, wherein when two items are on the first inspection conveyor, the inspection conveyor is movable to either its transfer or reject position and is indexed in either a forward or rearward direction to selectively reject or accept each item.

DETAILED DESCRIPTION OF THE PREFERRED EMBODIMENT

Figure 1:
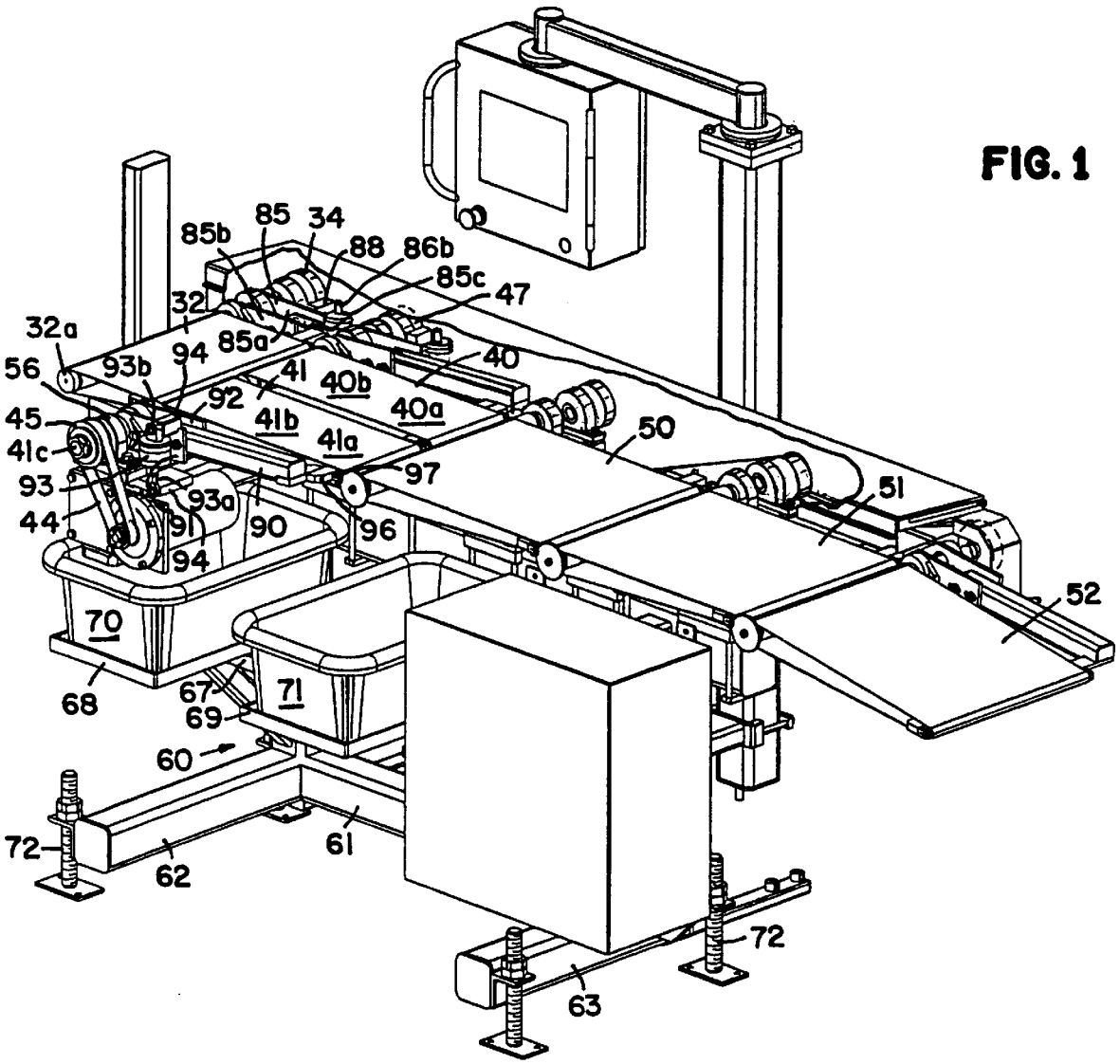
FIG. 1 is a perspective view of the two-directional reject and make-up conveyor system of the present invention, with one supply conveyor not being shown.
Figure 2:
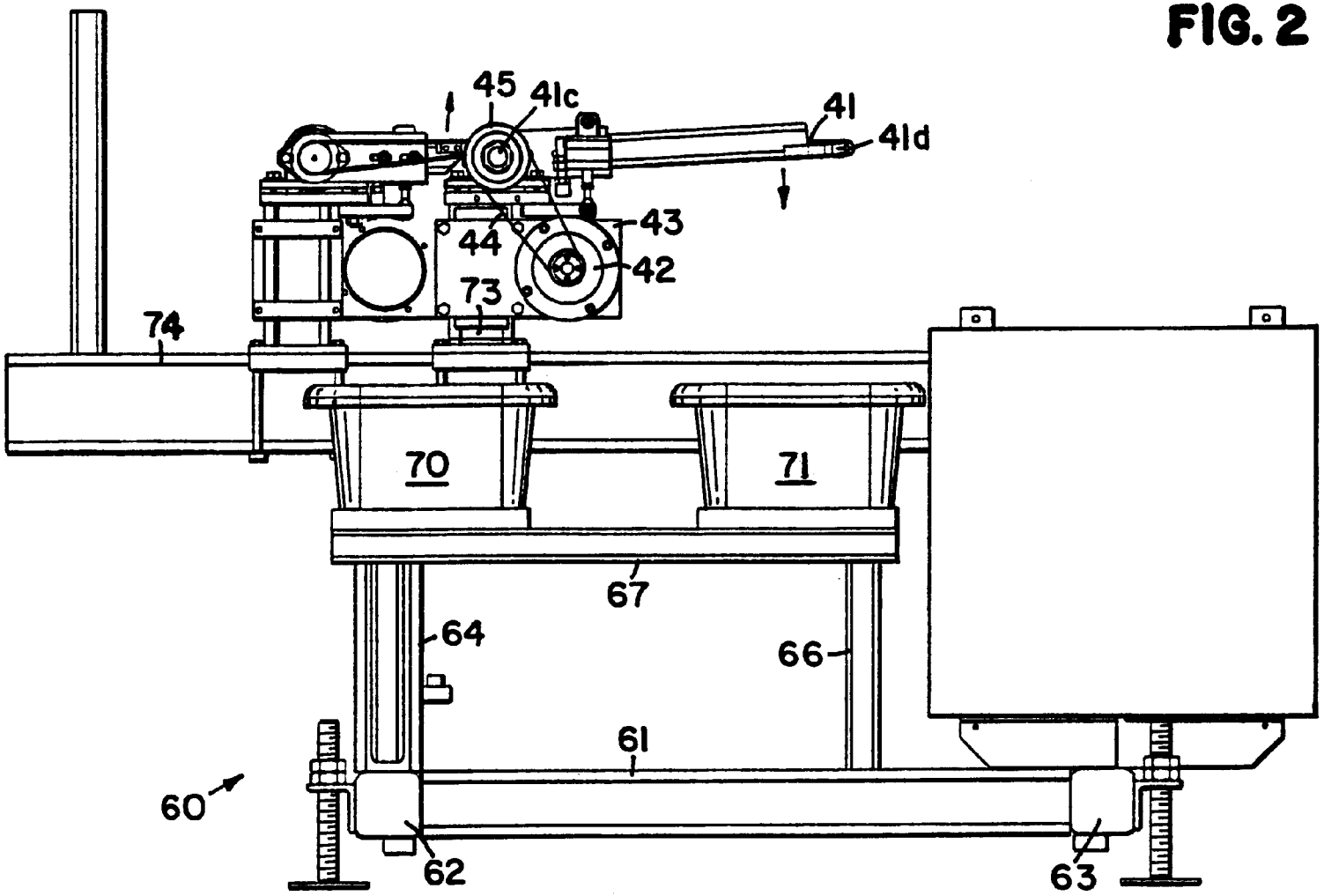
FIG. 2 is a front elevational view of the system shown in FIG. 1.
Figure 3:
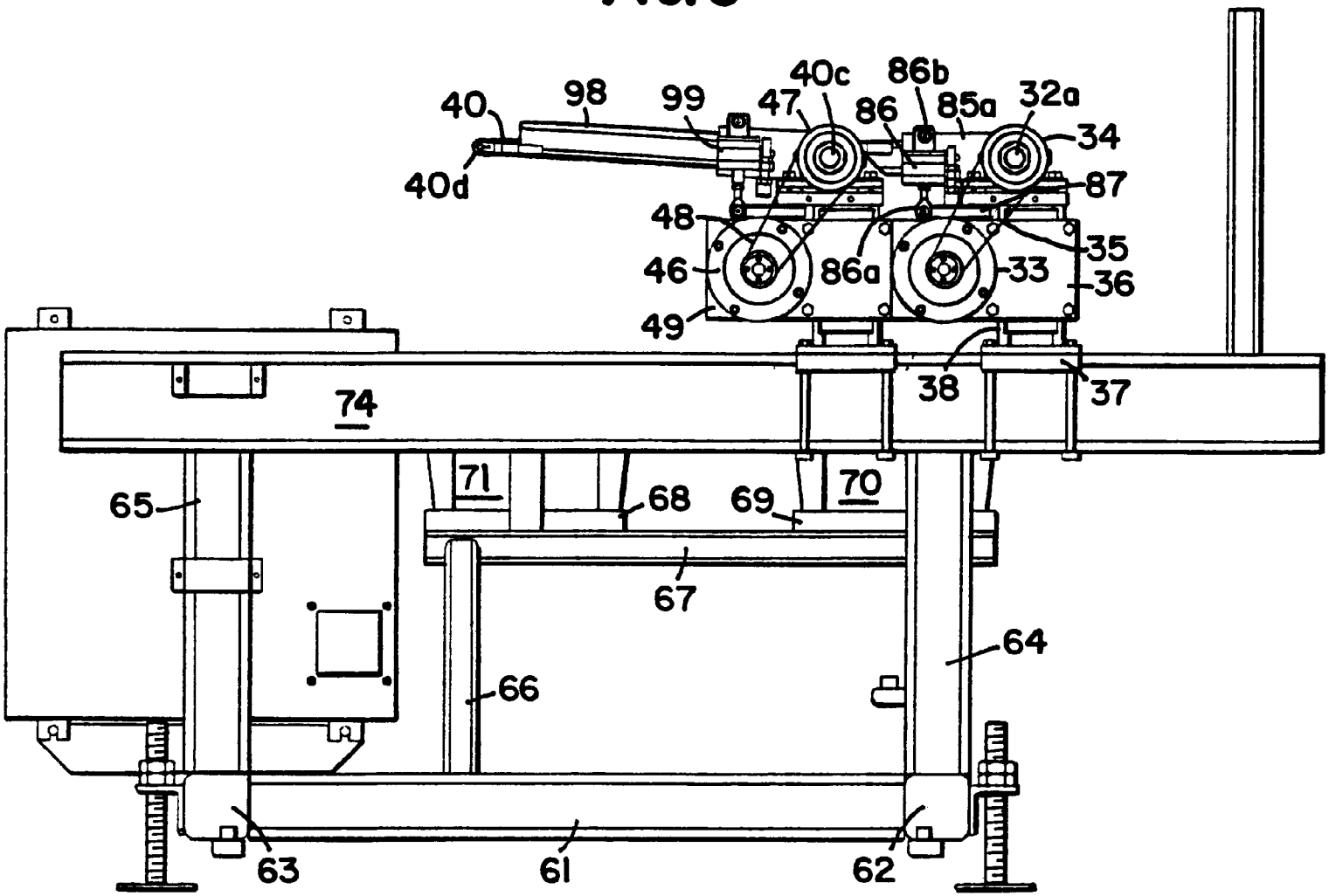
FIG. 3 is a rear elevational view of the system shown in FIG. 1.
Figure 4:
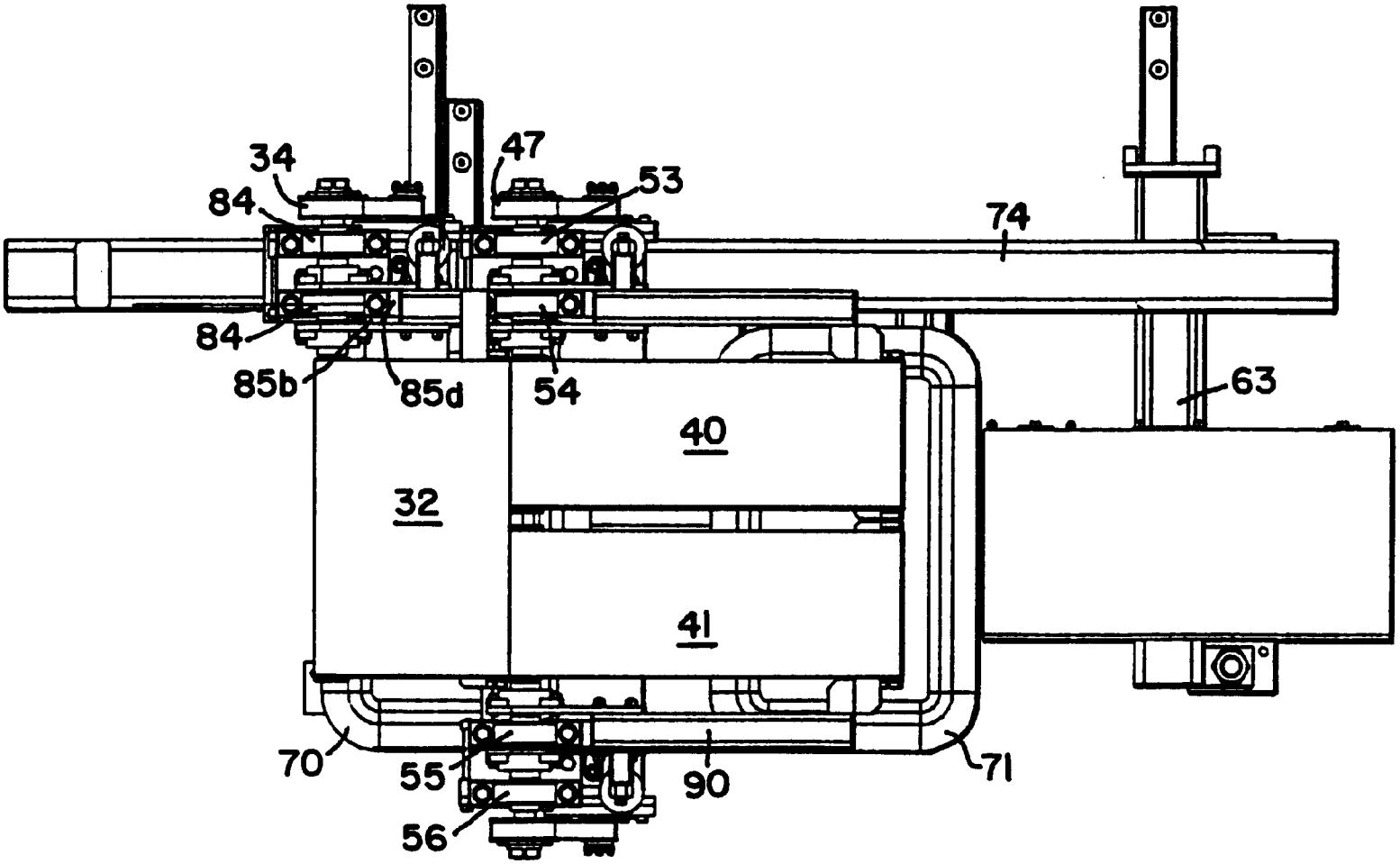
FIG. 4 is a top plan view of the system shown in FIG. 1.
Figure 5:
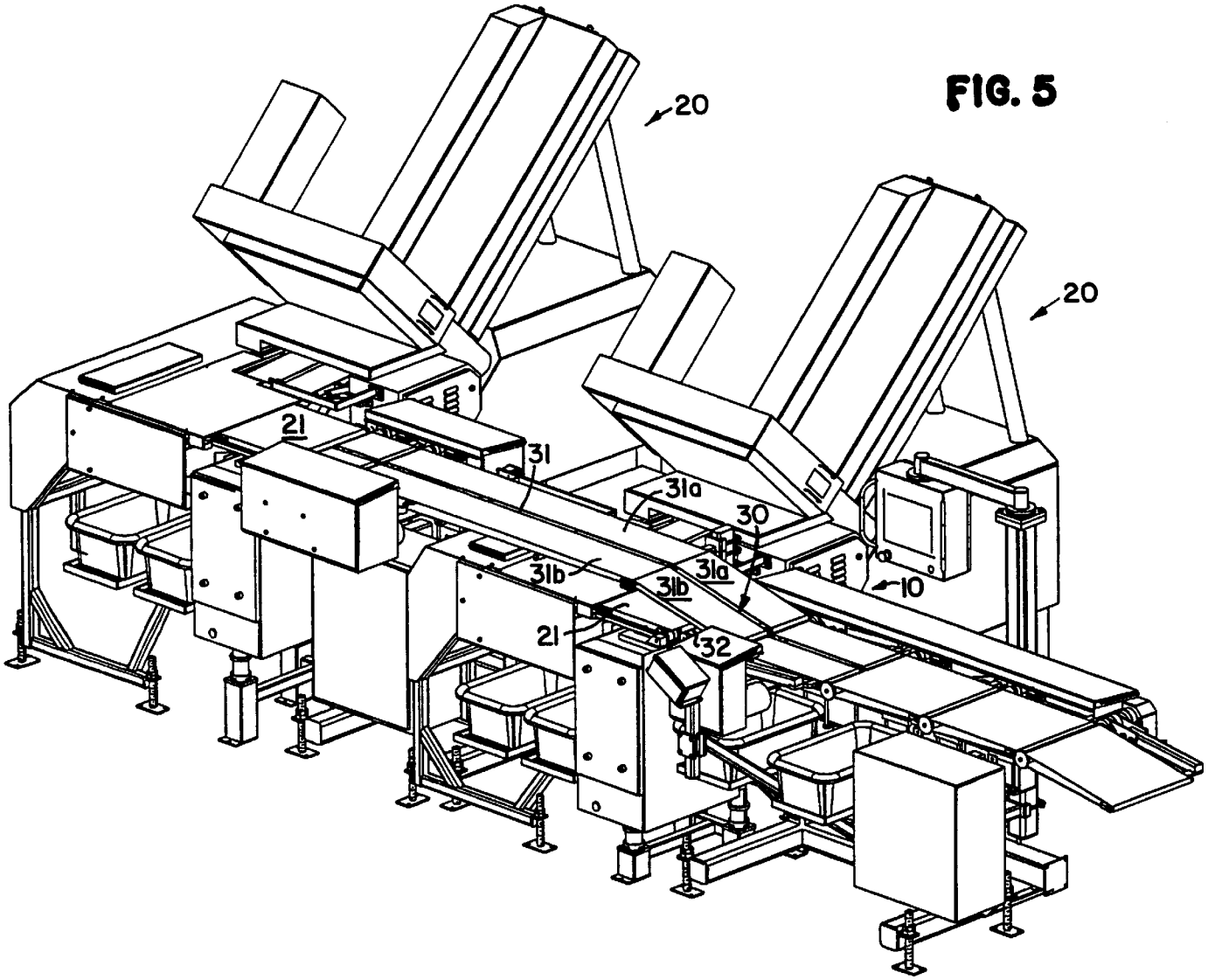
FIG. 5 is a perspective view of a bacon slicing line incorporating the two-directional reject and make-up conveyor system of the present invention.

Referring to the drawings, wherein like numerals represent like parts throughout the several views, there is generally disclosed at 10 a two-directional reject and make-up conveyor system. As seen in FIG. 5, there is shown two bacon slicing systems 20. The bacon slicing systems 20 are more fully described in my copending application filed the same date as the present application and is entitled Bacon Slicer System, which is hereby incorporated by reference. The bacon slicing system provides eight individual bacon slices to a weight check conveyor 21. There are two bacon slicing systems 20 shown, although it is appreciated that one bacon slicing system may be sufficient, depending upon the speed at which the packaging equipment operates. From the weight check conveyor 21, the bacon slices are transferred to a conveyor system, generally designated at 30. A draft of bacon refers to four slices of bacon, if there are four slices to a package. The supply conveyor system 30 includes a top supply conveyor 31 which has a first section 31*a* and a second section 31*b*. The sections 31*a* and 31*b* are controlled by separate servo motors (not shown). The servo motors and drive mechanisms for the top supply conveyor 31 are similar to the drive mechanisms for the inspection conveyors which are described in more detail hereafter. Each section 31*a* and 31*b* has a generally planar first portion and an inclined portion. The first portion and incline portion are one continuous conveyor and one drive motor drives both the first portion and the incline portion. The sections 31*a* and 31*b* are indexed forward independently by their own servo motor drive system. The supply conveyor system 30 also includes a bottom supply conveyor 32. The bottom supply conveyor 32, as shown in FIG. 1, is a single conveyor and is not split as is the top supply conveyor 31. There is a single drive mechanism which rotates the conveyor 32, as will be described more fully hereinafter. However, it is understood that the bottom supply conveyor 32 could also be split, similar to the top supply conveyor 31 and another drive mechanism added so that the sides could be individually controlled like the top supply conveyor 31. However, it has been found that under the current operating conditions, it is not necessary that the bottom supply conveyor be split and it is therefore less expensive to have a single bottom supply conveyor 32 with only one drive mechanism.

In FIGS. 1 through 4, the top supply conveyor 31 has been removed for clarity purposes. However, FIGS. 5 and 6 clearly show the top supply conveyor 31 in position. Proximate the supply conveyor system 30 is a first inspection conveyor 40 and a second inspection conveyor 41. The inspection conveyor 40 has a forward section 40*a* and a rear section 40*b*. Similarly, the inspection conveyor 41 has a front section 41*a* and a rear section 41*b*. Each section is sized to accommodate an item to be inspected. Downstream from the inspection conveyors 40 and 41 is a receiving conveyor 50. Downstream from the receiving conveyor 50 is an intermediate conveyor 51 and a packaging input conveyor 52 is downstream from the intermediate conveyor 51. The packaging input conveyor 52 feeds into a suitable packaging machine such as a Multivac R7000.

A frame is generally designated at 60. The frame may be any suitable frame to support the conveyor system 10. As shown in the drawings, the frame 60 is a welded frame and includes a central beam 61 having perpendicular beams 62 and 63. Upright beams 64 and 65 are connected to the central frame 61 and intermediate beam 66 also extends generally upward from the beam 61. A platform 67 is secured to the intermediate beam 66 and upright 64. The platform 67 supports two frames 68 and 69 on which bins 70 and 71 are removably positioned. A top beam 74 is connected to the upright beams 64 and 65 and is positioned over the central beam 61. Four feet 72 are suitably mounted to the frame 60 for providing height adjustment. A cross member 73 has one end welded to the top beam 74 and extends underneath the conveyor 40 and provides cantilevered support for the rear roller of the conveyor 40, as will be described more fully hereafter.

The top supply conveyor 31 is a split conveyor that has a first section 31*a* which is driven separately from the second section 31*b*. The bottom supply conveyor 32 has a back roller 32*a* that is driven by a drive motor 33 connected to a pulley 34 by a timing belt 35. The servo drive motor 33 is connected to a plate 36 which is in turn mounted to the top beam 74 for support by bracket 37. The bracket 37 is mounted to the beam 74 and is used to connect the upright frame 38 on which the plate 36 is secured. A similar drive mechanism is utilized to drive the top section 31*a* and another similar drive mechanism is utilized to drive the second section 31*b*.

Figure 6:
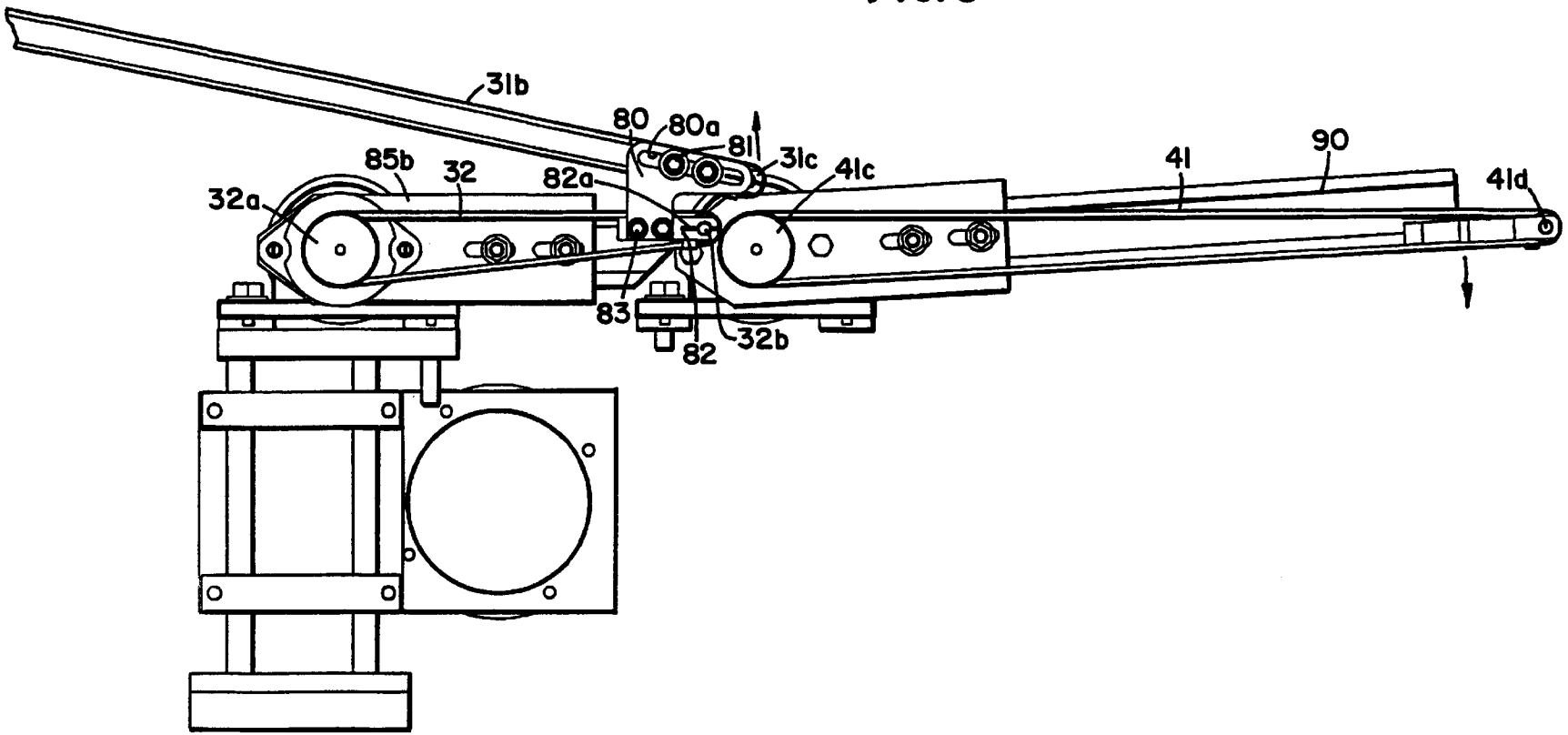
FIG. 6 is an enlarged partial side elevational view of a portion of the system shown in FIG. 1 with components removed for clarity.

As shown in FIG. 6, the ends of the conveyor 32 and conveyors 31*a* and 31*b* are connected by a bracket 80. A similar bracket is connected to both sides of the conveyors. The bracket 80 is generally an inverted L shape and has a slot 80*a* formed therein. Two bolts 81 extend through the slot 80*a* and connect the bracket 80 to the upper nose piece of the second section 31*b*. The nose piece includes the end roller 31*c*. The end roller 32*b* is better seen in FIG. 6 as only a portion of the end roll 31*c* as visible behind the bracket 80. The nose piece of the bottom supply conveyor 32 has its end roller 32*b* positioned in a clamp 82 that has a slot 82*a* formed therein. The roller 32*b* is captured in the slot 82 which has an opening proximate the size of the end roller 32*b*. This clamp 82 is then secured to the bracket 80 by two bolts 83. The clamp 80 therefore ties the ends of the conveyors 31*a* and 31*b* together with the end of the bottom supply conveyor 32 so that both ends may be raised, as will be described hereafter.

As can be seen in FIG. 6, the conveyor 32 is at the same elevation as the inspection conveyors 40 and 41. Further, the end of the conveyor 32 is adjacent the conveyors 40 and 41 thereby allowing for a transfer of bacon slices or other items which may be transported on the conveyors. The top supply conveyor 31*a* and 31*b* are positioned so that the end of the conveyors 31*a* and 31*b* extend slightly over the conveyors 40 and 41 so that the bacon slices or items are able to be transferred easily from one conveyor to the other. The transfer positions are defined as when the conveyors are in close proximation to each other such that the distance between them is sufficiently small to allow a direct transfer of an item between the conveyors without the items falling into a gap between the conveyors.

The roller 32*a* is carried in bearing blocks 84 which are concentric with the pulley 34. An arm assembly 85 is mounted on the shaft which carries the rollers 32*a* and is rotatable about its shaft. The arm assembly 85 has two arms 85*a* and 85*b* which are spaced apart. At the end opposite the bearing block, a block 85*c* is welded between the arms. A connecting member 85*d* is operatively connected to the block 85*c* at one end and at the other end to the bracket 80, by suitable means well known in the art. An air cylinder 86 has a first end 86*a* mounted to a plate 87 which is in turn connected to the frame 60. The second end 86*b* of the air cylinder 86 is connected via a connecting member 88 to the arm 85*a*. As shown in the figures, the cylinder 86 is in a retracted position. When the air cylinder extends, the second end 86*b* moves upward causing the arms 85*a* and 85*b* to rotate upward around the shaft carrying the roller 32*a*. This causes the end assemblies of the conveyors 31*a*, 31*b* and 32 to rotate upward providing for a gap between the supply conveyor system 30 and the inspection conveyors 40 and 41. When in the up position, the conveyors 31*a*, 31*b* and 32 are in a reject position.

Inspection conveyor 41 is mounted between rollers 41*c* and 41*d* and is driven by servo motor 42 which is mounted to plate 43 which is in turn mounted to the frame cross member 73. A drive belt 44 provides the motive force to the roller 41*c* through a pulley 45.

Similarly, a first inspection conveyor 40 is positioned between rollers 40*c* and 40*d*. A servo motor 46 drives the pulley 47 via timing belt 48. The servo motor 46 is mounted to a plate 49 which is in turn mounted to the frame 60. The rollers 40*c* land 41*c* are mounted in bearing blocks 53, 54 and 55, 56 respectively.

The forward sections 41*a* and 40*a* can be raised upward. They are raised similarly and only the mechanism with respect to the forward section 41*a* will be described in detail as the other mechanism for raising the section 40*a* is a mirror image. A bar 90 is secured between two arms 91 and 92. The arms 91 and 92, at their other ends, are rotatably mounted around the shaft carrying the roller 41*c*. An air cylinder 93 has a first end 93*a* mounted to plate 94 which is in turn mounted to the frame 60. The second end 93*b* of the air cylinder 93 is secured to a block 94 which is in turn connected to the arm 91. The end of the bar 90, opposite the shaft 41*c*, is connected via an intermediate member 96 to a bracket 97 that holds the roller 41*d*. As shown in the figures, the air cylinder 93 is in an extended position. Therefore, when the air cylinder retracts, the arm 90 moves downward causing rotation of the forward end 41*a* downward as shown by the arrow in FIG. 6. Similarly, air cylinder 99 rotates arm 98 and therefore forward section 40*a* downward.

As shown in the figures, the receiving conveyor 50 is at the same elevation as the inspection conveyors 40 and 41 and is positioned proximate the inspection conveyors 40 and 41 thereby allowing the transfer of bacon slices. However, when the forward sections 41*a* and 40*a* are rotated downward to a reject position, a gap is formed and items that are rotated on the belt 41 fall between the inspection conveyors and the receiving conveyor into the bin 71.

The servo motors and piston may be controlled by suitable controls and programming, well known in the art. An example of such controls will be described with respect to the operation of the invention.

The reject and make-up conveyor system of the present invention is shown being used with bacon slicers 20. The operation will be described with respect to the inspection of bacon slices, although it will be appreciated that other items may also be inspected for subsequent packaging. In describing the operation of this invention, reference will be made to FIG. 7. There, a schematic representation of conveyors 31, 32, 40 and 41 is shown. Twelve items to be inspected are shown and are represented by the numerals 1 through 12. In the preferred embodiment, each numeral represents at item which represents four individual slices of bacon that are to be packaged by a packaging machine. The packaging machine packages four items at a time. In order to have an efficient production line, it is important to have four items that have been inspected for quality available for packaging. Further, such lines typically run at high speeds and therefore it is important to have a system which can efficiently reject items of poor quality and have them replaced quickly.

The items 1 through 12 are placed on the conveyors 31 and 32 in a side by side relationship. Therefore, when the conveyor 32 is indexed forward, two items are indexed forward, one onto conveyor 40 and one on to conveyor 41. Conveyors 31*a* and 31*b* may be operated independently or simultaneously. When feeding a blank conveyor 40 or 41, they would be operated at the same time and one item would be advanced onto conveyor 41 and another onto conveyor 42.

Figure 7:
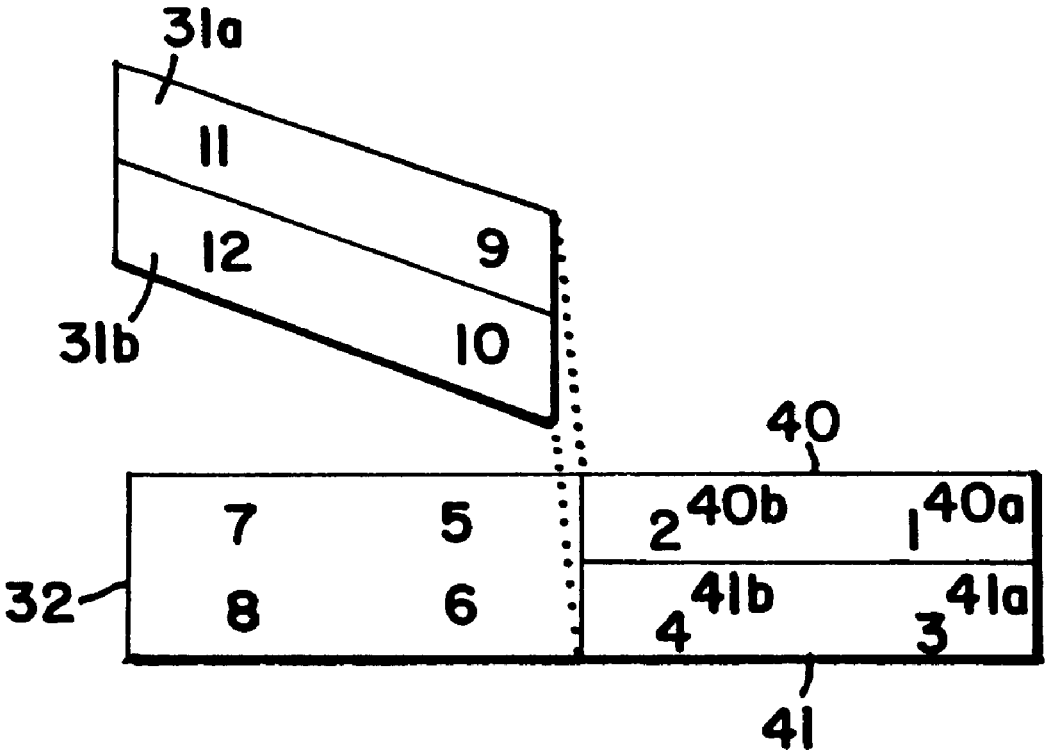
FIG. 7 is a schematic representation of items to be inspected on the reject and make-up conveyors, with the top conveyor exploded away for clarity.

Starting with the position shown in FIG. 7, an inspector would make a determination if the items were of acceptable quality. This inspection can be done either manually or through use of other automated inspection systems suitable for the items being inspected. If all items 1 through 4 are acceptable, the operator would activate a control which would move conveyors 40 and 41 forward two positions. This would transfer items 1 through 4 onto the receiving conveyor 50. Items 1 through 4 would be of acceptable quality and would be in the proper position for subsequent packaging. The items would then simply be transferred in that order onto conveyors 51 and then 52 and ultimately to the packaging machine. As shown in the figures, the conveyors are all in a transfer position. That is, they are positioned so that when the conveyors are activated, the items being transported are moved onto the next down stream conveyor. Activation of the air cylinder 86, as previously described, causes the supply conveyor system 30 to rotate upward around the shaft carrying the roller 32*a*. This creates a gap between the supply conveyor system 30 and the inspection conveyors 40 and 41. This is the reject position and rotation of the inspection conveyors 40 and 41 backwards would cause the items being inspected to fall into the reject bin 70. Activation of the piston 93, as previously described, causes the forward end of the inspection conveyor 41 to rotate downward. This moves the conveyor away from the transfer position to a reject position. Then, if the conveyor 41 is indexed forward while in the reject position, the item would fall into the reject bin 71. Similarly, activation of the piston 99 causes the front end of the conveyor 40 to rotate downward to a reject position. In the reject position, indexing of the conveyor 40 would cause items on the conveyor to fall into the reject bin 71.

Referring now again to FIG. 7, if the inspector determines that item 1 is defective, suitable controls would be activated to activate cylinder 99 to position the conveyor 40 in a reject position and the inspection conveyor 40 would be indexed forward to cause item 1 to fall into the reject bin 71. This would automatically move item 2 to the position previously held by item 1. Simultaneously, the first section 31*a* is indexed forward causing item 9 to take the position previously held by item 2. This then provides for four items to be indexed forward into the packaging machine. This assumes that item 9 is of acceptable quality after inspection.

Another scenario would be where item 2 is defective. In this instance, the air cylinder 86 is activated and the inspection conveyor 40 is indexed rearward causing item 2 to fall into the reject bin 70. This moves item 1 to the position previously held by item 2. Then, the air cylinder 86 is released causing the conveyor 31*a* to move into a transfer position. The conveyor 40 and 31*a* are then both simultaneously indexed moving item 1 back to its original position and having item 9 in the position originally held by item 2. As can be seen, when an item is rejected downstream, there is a simultaneous make-up item supplied from the supply/make-up conveyor.

If items 3 or 4 were defective, the same procedure would be applicable using conveyors 31*b* and 41.

The split upper conveyor, along with indexing the inspection conveyors forward and backward allows for a very versatile system which can accommodate any combination of defective items 1 through 4. For instance, if items 1 and 3 were defective, both cylinders 99 and 93 would be activated and conveyors 40 and 41 would be indexed forward, causing items 1 and 3 to be rejected with items 2 and 4 taking the place of items 1 and 3. Simultaneously, the bottom supply conveyor 32 would be activated causing items 5 and 6 to replace the position previously occupied by items 2 and 4. Alternately, both conveyors 31*a* and 31*b* could be activated having items 9 and 10 replace items 2 and 4.

If items 2 and 4 were defective, they would be indexed backwards into the reject bin 70 and then upon forward indexing of both 40 and 41, items 1 and 3 would return to their original position and items 2 and 4 would be replaced by either items 5 and 6 or items 9 and 10, depending upon whether or not conveyor 32 or conveyors 31*a* and 31*b* were indexed forward.

Another scenario would be if items 1 and 2 were both defective. In this condition, conveyor 40 would be indexed forward two positions and both items 1 and 2 would be rejected into the bin 71 and items 9 and 11 would replace items 1 and 2 in the same movement. Similarly, if items 3 and 4 were rejected, they would be indexed forward into the reject bin 71 and items 10 and 12 would replace items 3 and 4 in the same movement. It would be possible to index both items 1 and 2 or items 3 and 4 backward to reject them into the bin 70. However, this would take additional time as compared to rejecting the items forward because as the items were rejected forward, they are simultaneously replaced from supply conveyors 31*a* or 31*b*.

While not shown, it is understood that suitable controls and programming may be utilized to more easily effect the inspection. It is envisioned that an operator would simply activate a switch indicating which one or ones of the four items being inspected were rejected. Then, the respective air cylinders would be activated and conveyors indexed automatically to effect the necessary movements. It is also understood that various options could be made to create transfer and reject positions between the conveyors. That is, the receiving conveyor 51 could be rotated upward to create a reject position. Also, the back end of the conveyors 40 and 41 could rotate downward to create a transfer position with the supply conveyor system remaining stationery. Also, the system could be operated with a single supply conveyor as opposed to the top and bottom supply conveyors to accommodate two bacon machines. However, there would still be the need to separately be able to make up items selectively to either conveyors 40 or 41. Therefore, the split supply/make-up conveyor is an important feature of the present invention. It is also understood that the bottom supply conveyor 32 could be split into two conveyors. However, it has been found that having one split conveyor, conveyor 31, is sufficient.

While the invention has been described with respect to two inspection conveyors and two supply conveyors, it is appreciated that the invention also would include more than two inspection and supply conveyors where first and second items may be positioned on first, second, third or more conveyors. Further, the invention is equally applicable to a system wherein there is only one inspection conveyor and one supply conveyor.

The above specification, examples and data provide a complete description of the manufacture and use of the composition of the invention. Since many embodiments of the invention can be made without departing from the spirit and scope of the invention, the invention resides in the claims hereinafter appended.

We claim:

1. A method of inspecting items comprising:

(a) sequentially placing a first forward item and a second rear item on a first inspection conveyor;

(b) inspecting the two items;

(c) selectively rejecting any item that is not acceptable by indexing the first inspection conveyor either forward or backward depending on whether the item occupies a forward or rear position; and (d) making up for any rejected item by supplying a make-up item from a first supply conveyor to the first inspection conveyor.

2. The method of claim 1, further comprising:

(a) sequentially placing a third and a fourth item on a second inspection conveyor;

(b) inspecting all four items;

(c) selectively rejecting any item that is not acceptable by indexing the second inspection conveyor either forward or backward depending on whether the item occupies a forward or rear position; and (d) making up for any rejected items by supplying a make-up item from a second supply conveyor to the second inspection conveyor.

3. The method of claim 2, further comprising simultaneously supplying items to both the first and second inspection conveyors from a third supply conveyor.

4. The method of claim 3, wherein the simultaneously supplied items are supplied from the third supply conveyor, which is a single conveyor.

5. The method of claim 2, further comprising moving a forward end of the first inspection conveyor downward when rejecting an item by indexing the first inspection conveyor forward.

6. The method of claim 5, further comprising:

(a) sequentially placing the items on the inspection conveyors from a supply conveyor within a close proximation of the inspection conveyor; and (b) moving the supply conveyor upward when rejecting an item by indexing the supply conveyor backward.

7. A method of inspecting and conveying bacon to a packaging machine, comprising:

(a) sequentially placing a first forward bacon draft and a second rear bacon draft on a first inspection conveyor;

(b) sequentially placing a third forward bacon draft and a fourth bacon draft on a second supply conveyor;

(c) inspecting the four bacon drafts;

(d) selectively rejecting any bacon draft that is not acceptable by indexing the inspection conveyors either forward or backward depending on whether the item occupies a forward or rear position; and (e) making up for any rejected bacon draft by supplying a make-up bacon draft from a first supply conveyor to the first inspection conveyor and from a second supply conveyor to the second inspection conveyor.

8. The method of claim 7, further comprising simultaneously supplying items to both the first and second inspection conveyors from a third supply conveyor.

9. The method of claim 8, wherein the simultaneously supplied items are supplied from the third supply conveyor, which is a single conveyor.

10. The method of claim 9, further comprising moving a forward end of the first inspection conveyor downward when rejecting an item by indexing the first inspection conveyor forward.

11. The method of claim 10, further comprising:

(a) sequentially placing the items on the inspection conveyors from a supply conveyor within a close proximation of the inspection conveyor; and (b) moving the supply conveyor upward when rejecting an item by indexing the supply conveyor backward.

12. The method of claim 7, wherein each bacon draft comprises a plurality of bacon slices.

13. A two-directional reject and make-up conveyor system for inspecting items comprising:

(a) a first inspection conveyor having a forward section and a rear section, each section sized to accommodate an item to be inspected;

(b) a first drive mechanism for indexing the first conveyor both forward and backward;

(c) a first supply conveyor for supplying the item to be inspected to the first inspection conveyor;

(d) a receiving conveyor for receiving two inspected items from the first inspection conveyor;

(e) the forward section of the first inspection conveyor, in cooperation with the receiving conveyor, has a transfer position and a reject position; and (f) the rear section of the first inspection conveyor, in cooperation with the first supply conveyor, has a transfer position and a reject position, wherein when two items are on the first inspection conveyor, the inspection conveyor is moveable to either its transfer or reject position and is indexable in either a forward or rearward direction to selectively reject or accept each item.

14. A two-directional reject and make-up conveyor system for inspecting items comprising:

(a) a first inspection conveyor having a forward section and a rear section, each section sized to accommodate an item to be inspected;

(b) a first drive mechanism for indexing the first conveyor both forward and backward;

(c) a second inspection conveyor having a forward section and a rear section, each section sized to accommodate an item to be inspected;

(d) a second drive mechanism for indexing the second conveyor both forward and backward;

(e) a first supply conveyor for supplying the item to be inspected to the first inspection conveyor;

(f) a second supply conveyor for supplying the item to be inspected to the second inspection conveyor;

(g) a receiving conveyor for receiving two inspected items from the first inspection conveyor, and two inspected items from the second inspection conveyor;

(h) the forward section of the first inspection conveyor, in cooperation with the receiving conveyor, has a transfer position and a reject position;

(i) the forward section of the second inspection conveyor, in cooperation with the receiving conveyor, has a transfer position and a reject position;

(j) the rear section of the first inspection conveyor, in cooperation with the first supply conveyor, has a transfer position and a reject position; and (k) the rear section of the second inspection conveyor, in cooperation with the second supply conveyor, has a transfer position and a reject position, wherein when two items are on the first and second supply conveyors, each supply conveyor is moveable to either its transfer or reject position and each is indexable in either a forward or rearward direction to selectively reject or accept each item.

15. The system of claim 14, further comprising a third supply conveyor positioned proximate the rear sections of both the first and second inspection conveyors, wherein items are supplied to both inspection conveyors.

16. The system of claim 14, further comprising the inspection conveyors mounted for rotational movement to a frame, wherein the forward sections rotate downward to the reject position of the receiving conveyor and the inspection conveyors.

17. The system of claim 16, further comprising the first and second supply conveyors mounted for lateral movement to a frame, wherein the supply conveyors move vertically upward to the reject position of the supply and inspection conveyors.

* * * * *